United States Patent [19]

Gipe

[11] 4,031,614

[45] June 28, 1977

[54] METHOD OF MAKING TWO-PIECE ELECTRICAL CONTACT

[75] Inventor: Richard Earl Gipe, Warren, Pa.

[73] Assignee: GTE Sylvania Incorporated, Stamford, Conn.

[22] Filed: Nov. 19, 1975

[21] Appl. No.: 633,179

[52] U.S. Cl. ..... 29/630 A; 29/629; 113/119; 339/256 SP

[51] Int. Cl.[2] ..... H01R 9/00

[58] Field of Search ..... 29/629, 630 R, 630 A, 29/628; 113/119; 339/275 T, 256 SP, 258 S

[56] References Cited

UNITED STATES PATENTS

| | | | |
|---|---|---|---|
| 2,511,806 | 6/1950 | Macy | 113/119 |
| 2,987,697 | 6/1961 | Davis | 29/630 A X |
| 3,058,091 | 10/1962 | Henschen | 29/630 A |
| 3,241,218 | 3/1966 | Phillips | 29/630 A |
| 3,467,942 | 9/1969 | Dell et al. | 339/49 R |
| 3,660,806 | 5/1972 | De Stephan | 339/256 SP |
| 3,842,391 | 10/1974 | Dechelette | 339/256 SP X |

*Primary Examiner*—James R. Duzan
*Attorney, Agent, or Firm*—Norman J. O'Malley; Lawrence R. Fraley; Donald R. Castle

[57] ABSTRACT

The invention concerns the manufacture of two-piece electrical contacts. The contacts produced by the present invention are adapted for electrically interconnecting an electrical wire with either a male pin or a female contact. The invention as described features a pair of forming steps to form each of the pieces and a step to join said pieces at the desired location.

5 Claims, 7 Drawing Figures

METHOD OF MAKING TWO-PIECE ELECTRICAL CONTACT

BACKGROUND OF THE INVENTION

This invention relates to the manufacture of electrical contacts and more particularly to methods of producing electrical contacts adapted for electrically interconnecting an electrical wire with either a male contact pin or a female contact.

Still further, the invention relates to methods of making electrical contacts wherein the produced contacts may be positioned within an electrically insulative housing.

Contacts of the variety described above have usually been manufactured by processes utilizing a complex molding and forming operation. Mostly, these contacts have been produced from a single material which in turn is subjected to multiple operations such as stamping, bending, rolling, etc. The resulting product was thereafter only able to satisfy a single function, that is, interconnect an electrical wire with another wire or a wire with a male or female component. Those adapted for joining wires with male components were not able to accept a female component, and vice-versa. Similarly, those adapted for joining wires to wires were unable to connect a wire to a corresponding male or female member. Being unitary in structure, such contacts have therefore lacked the feature of versatility so often desired in the electronics field.

Examples of the above contacts are represented in U.S. Pat. No. 3,467,942 wherein FIGS. 3 and 4 depict male and female mating members each of which has been joined to an electrical wire. As is understood, each of these contacts is produced from a unitary material which in turn is formed through a series of often complicated forming operations (i.e., stamping using multiple dies) to provide the end product. As can further be seen in U.S. Pat. No. 3,467,942, the housing required to retain the illustrated contacts is itself rather complicated in design, thus further necessitating a complex molding operation to achieve its formation. Otherwise, two separate and distinct molding operations for different housings (one for each type contact) are required.

It is believed therefore that a method of producing electrical contacts which features interchangeability of components and therefore a substantial reduction in the number and complexity of molding operations necessary to provide housings for these contacts would constitute an advancement in the art.

OBJECTS AND SUMMARY OF THE INVENTION

Accordingly, it is a primary object of the present invention to facilitate the manufacture of electrical contacts adapted for electrically interconnecting an electrical wire with either a female or a male contacting member.

It is a further object of this invention to provide a method for producing electrical contacts wherein interchangeability of the components of each is possible, thus substantially reducing the heretofore known complex forming and molding operations of In accordance with one aspect of the invention, there is provided a method of making a two-piece electrical contact adapted for electrically interconnecting a male pin and an electrical wire. The method comprises forming one of the two pieces to provide a female receptive member having an elongated reception portion for receiving and electrically engaging said male pin. This piece further includes a wrappable end portion. The method further comprises a second forming operation for forming a second of said two pieces to provide a deformable member for positively retaining the electrical wire. The method even further comprises a joining step wherein the wrappable end portion of the female receptive member is joined to the deformable member to provide said two-piece electrical contact.

In accordance with another aspect of the invention, there is provided a method for making a two-piece electrical contact adapted for electrically interconnecting a female contact and an electrical wire. The method comprises forming one of said two pieces to provide an elongated male pin member, forming a second of said two pieces to provide a deformable member, and joining said male pin member to said deformable member to provide said two-piece electrical contact.

DETAILED DESCRIPTION OF THE PREFERRED EMBODIMENTS

For a better understanding of the present invention, together with other and further objects, advantages and capabilities thereof, reference is made to the following disclosure and appended claims in connection with the above-described drawings.

As will be understood, the contacts produced by the invention are each of a two-piece assembly, thus permitting interchangeability of pieces during manufacture. This feature significantly reduces the costs of producing such contacts by reducing the number of forming operations necessary. Further, because the resulting contacts are much simpler in configuration, complex molding operations previously necessary to produce housings for said contacts have been virtually eliminated.

Figure 1:
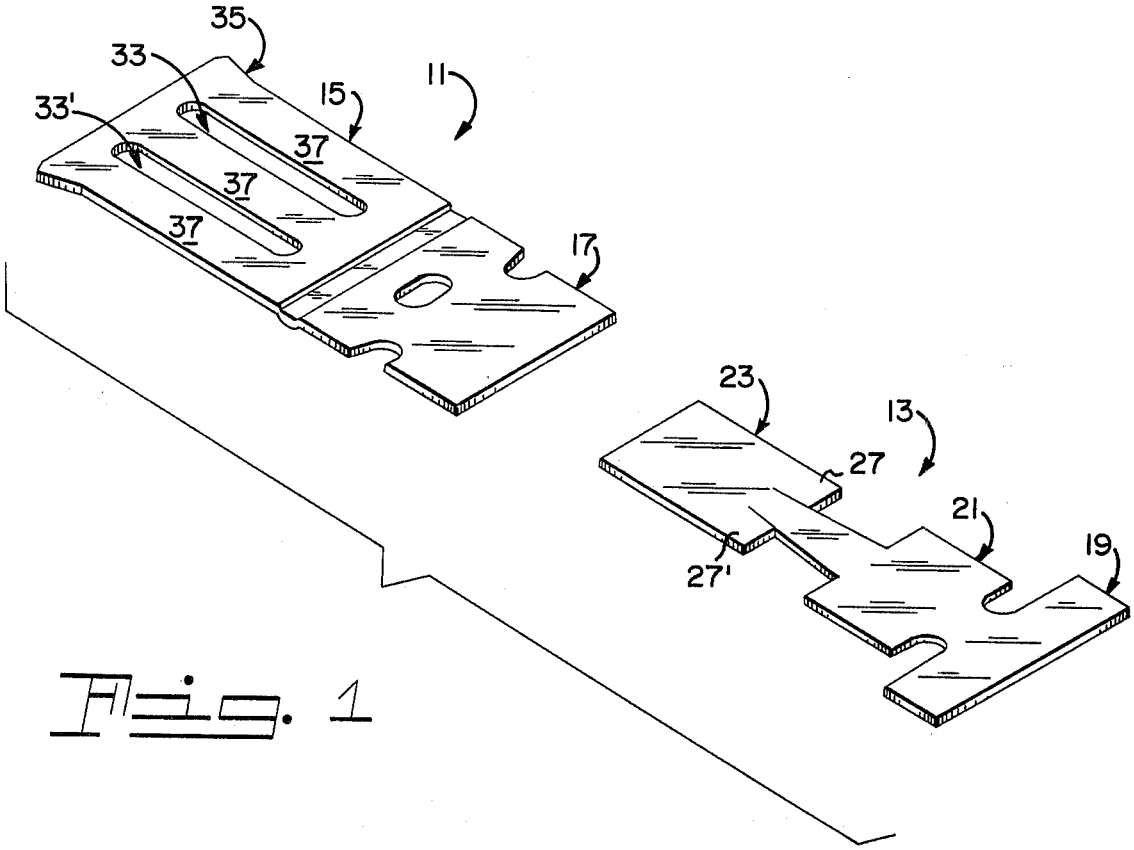
FIG. 1 is an isometric view of two preferred embodiments of pieces for utilization in the electrical contact produced by the method of the present invention.

FIG. 1 represents two preferred embodiments for pieces to be utilized in an electrical contact produced by the method of the present invention. As shown, each of said pieces are of substantially flat configuration and formed from a metallic material having substantially uniform thickness. The preferred method for forming each of the shown pieces is to utilize a common stamping operation wherein the substantially flat uniformly thick metallic material is subjected to a series of stamping steps in which various formations are provided as well as portions of the material removed therefrom. The to-be-formed contact is shown as comprising a female receptive member 11 and a deformable member 13. Female receptive member 11 when utilized in the contact formed by the method of the invention is adapted for receiving and electrically engaging a male contact. As shown, female receptive member 11 includes an elongated reception portion 15 for receiving and engaging said male pin and a wrappable end portion 17. Wrappable end portion 17, as will be described, provides a means for securing female receptive member 11 to deformable member 13.

Figure 5:
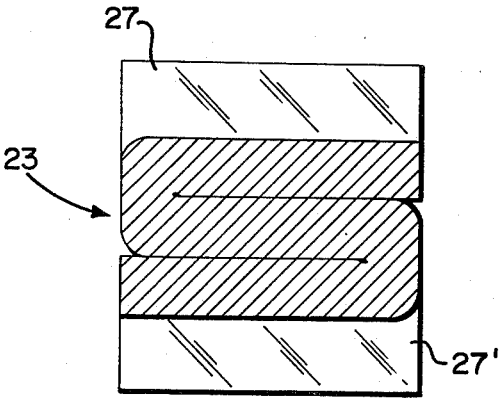
FIG. 5 is a sectional view taken along the line 5—5 in FIGS. 2 and 4.

Member 13 is adapted for positively retaining an electrical wire having an electrically conductive lead portion and at least one layer of an electrically insulative material formed thereabout. In FIG. 1, deformable member 13 includes a first end portion 19 adapted for positively retaining the described insulative coating on said electrical wire, an intermediate portion 21 for electrically engaging the electrically conductive lead portion of said wire, and a second end portion 23 opposingly positioned from first end portion 19. As will be described, second end portion 23 is subsequently formed to a multi-layered configuration and thereafter joined to wrappable end portion 17 of female receptive member 11. This is achieved by subjecting second end portion 23 to a bending operation wherein end portion 23 is formed to a three-layered body. Attention is called to FIG. 5, taken along the line 5—5 in FIG. 2, wherein this three-layered body is shown in section. For reasons of clarification, the wrappable end portion 17 of female receptive member 11 is not shown in FIG. 5. As previously stated, the three-layered embodiment illustrated in FIG. 5 is achieved preferably by a bending operation wherein the substantially equally sized three portions of second opposing end 23 are bent in the manner illustrated.

Figure 2:
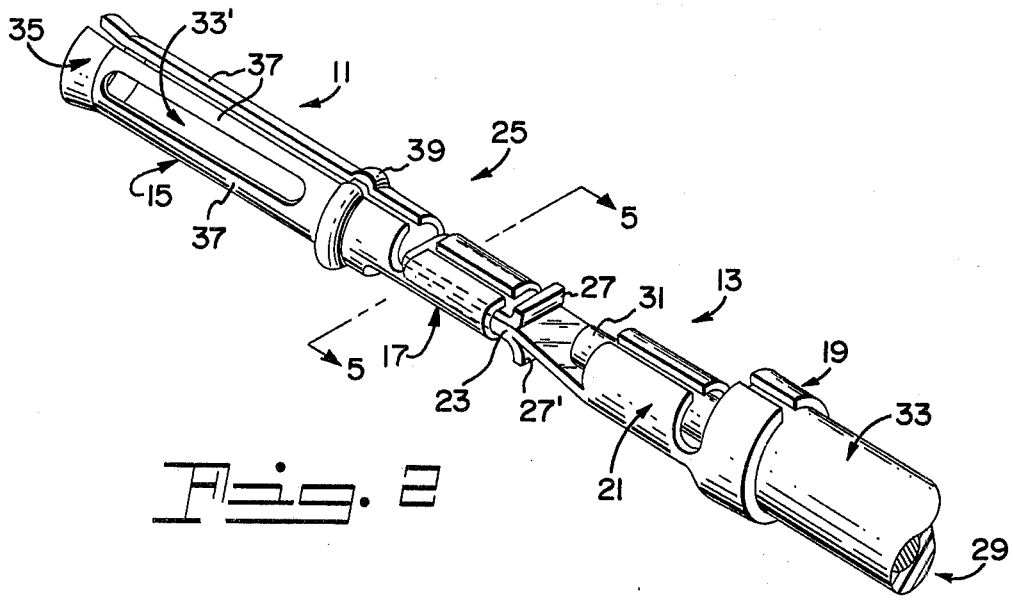
FIG. 2 is an isometric view of an electrical contact assembled by the method of the invention using the pieces shown in FIG. 1.

With particular reference to FIG. 2, a two-piece electrical contact 25 is shown as assembled utilizing the components previously described in FIG. 1. It can be seen that second end portion 23 of deformable member 13 has been formed to the multi-layered configuration defined and thereafter provided with a pair of opposing upstanding tab members 27 and 27'. The purposes for these tab members will be described with the embodiment illustrated in FIGS. 6 and 7. Once formed to the multi-layered configuration, second end portion 23 is positioned relative to wrappable end portion 17 and the end portion 17 substantially wrapped thereabout. This process may occur prior to or after bending or rolling of elongated reception portion 15 of the female receptive member 11. Similarly, formation of the multi-layered configuration for end portion 23 of deformable member 13 may be achieved prior to or after formation of the intermediate and first end portions 21 and 19 respectively of member 13.

As illustrated in FIG. 2, deformable member 13 is adapted for positively retaining an electrical wire 29 having an electrically conductive lead portion 31 and at least one layer of an insulative material 33 formed substantially about lead portion 31. Accordingly, intermediate portion 21 of deformable member 13 electrically engages and positively retains lead portion 31 of wire 29 and first end portion 19 positively retains insulative material 33 of said wire. Thus, there has been formed a two-piece electrical contact 25 adapted for electrically interconnecting a male pin (not shown) to be positioned within the female receptive member 11 of the contact and for positively retaining an electrical wire 29 within the deformable member 13 of said contact 25. It is understood of course that the ultimate function of contact 25 is to provide for electrical interconnection between the electrically conductive lead 31 of wire 29 and said male pin once the male pin is inserted within contact 25.

In the simplest embodiment of the invention, joining of female receptive member 11 to deformable member 13 is accomplished by wrapping wrappable end 17 about the multi-layered formed end 23. To provide a more positive means for joining members 11 and 13, it is preferred to subsequently weld multi-layered second end portion 23 to wrappable end 17 after end 17 has been substantially wrapped about the multi-layered second end portion.

As shown in FIGS. 1 and 2, female receptive member 11 has at least two open portions 33 and 33' therein. Removal of portions 33 and 33' is accomplished during the previously described stamping operation. Similarly, female receptive member 11 is provided with an angular end portion 35. The purpose of providing openings 33 and 33' within member 11 is to facilitate entrance of a male pin by permitting flexing or similar bending of the arms 37 of receptive portion 15. The purpose of angular end portion 35 is also to facilitate insertion of said male pin. Member 11 is also preferably provided with an upstanding peripheral portion 39 to assist in the mentioned flexing movement of portion 15.

Figure 3:
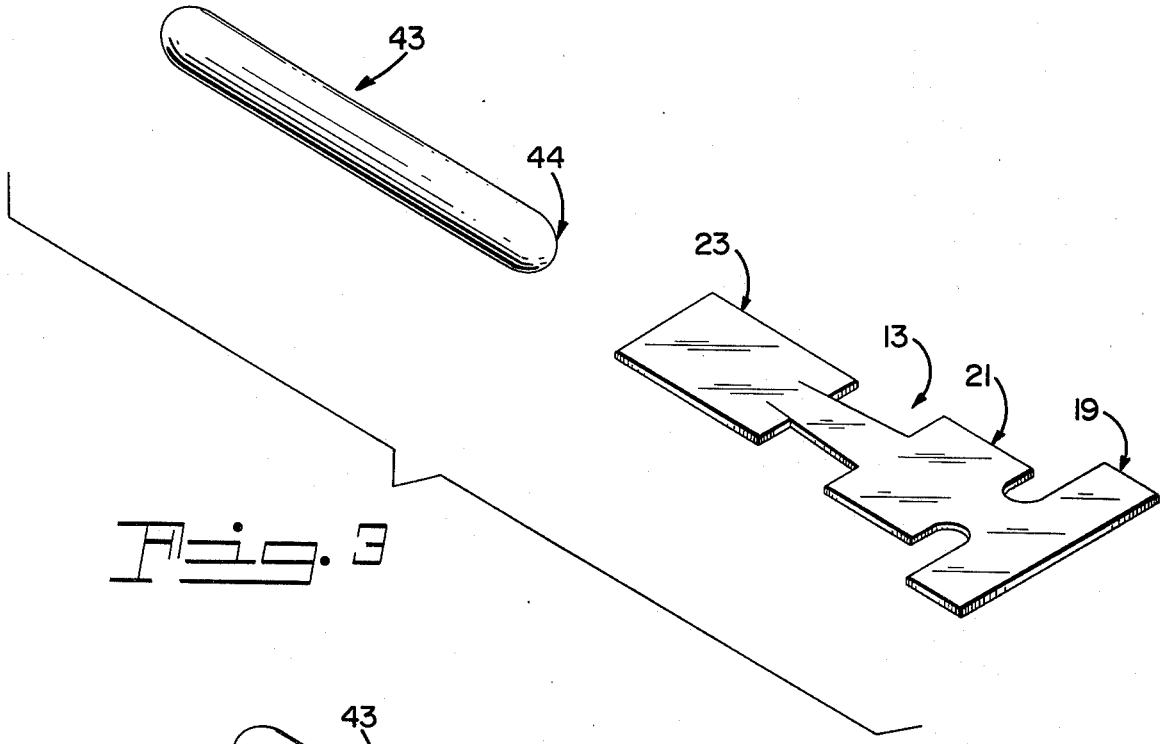
FIG. 3 is an isometric view of the preferred embodiments of pieces for utilization in another electrical contact produced by the method of the present invention.
Figure 4:
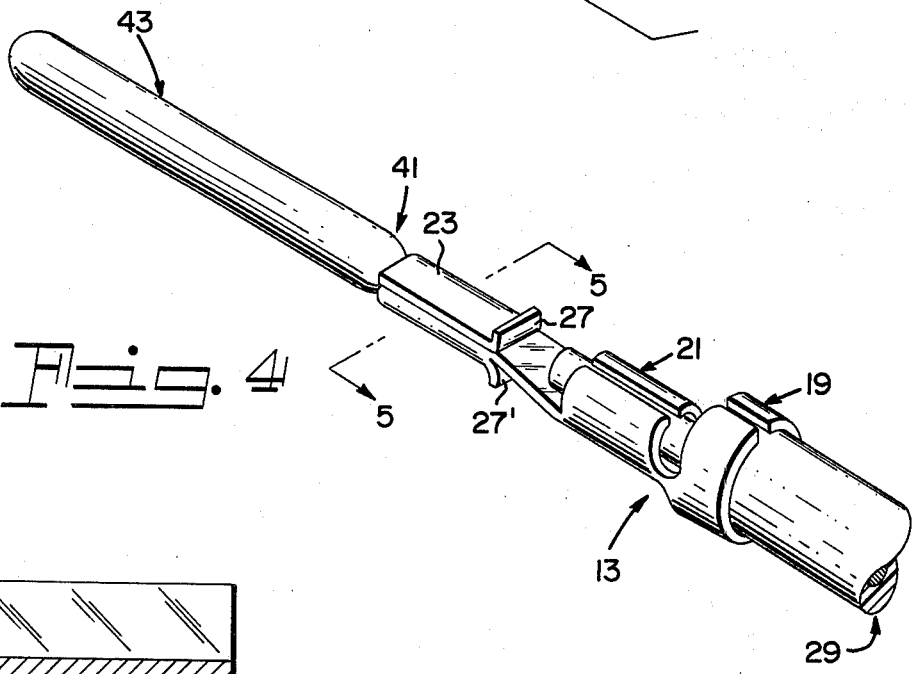
FIG. 4 is an isometric view of an electrical contact assembled by the method of the invention using the pieces shown in FIG. 3.

FIGS. 3 and 4 represent another embodiment of a two piece electrical contact which may be formed in accordance with the method of the present invention. As illustrated therein, the formed two piece electrical contact 41 (FIG. 4) is comprised of an elongated male pin 43 and the previously described deformable member 13. Utilization of the deformable member 13 in the embodiment of FIGS. 3 and 4 thus facilitates interchangeability of components to form the contacts defined. This feature additionally eliminates the necessity for providing several different and relatively complicated insulative housings for retaining the formed contacts 25 and 41. As previously described, deformable member 13 is formed utilizing a stamping operation wherein the configuration illustrated is formed. In this embodiment, the previously described formation of the multi-layered end portion 23 is also achieved by a bending operation. Additionally, end portion 23 is provided with the upstanding tabs 27 and 27' similar to corresponding tabs 27 and 27' in contact 25. Intermediate portion 21 and first opposing end portion 19 are also formed in the manner illustrated either prior to or subsequent to formation of multi-layered end 23 to positively retain wire 29 therein.

After forming multi-layered end portion 23, deformable member 13 is positively joined to male pin 43 at one end 44 thereof. The preferred method for joining said members is welding although it is understood that other methods well within the scope of the art are possible. The provision of the three-layered end portion 23 on deformable member 13 thus assures an end of substantial size to facilitate welding thereto of male pin 43.

The method as described thus provides a two-piece electrical contact 41 which is adapted for electrically interconnecting a female contact into which male pin 43 is inserted and an electrical wire 29 positively retained by deformable member 13 of contact 41. As stated, the deformable member 13 is formed by utilization of a stamping operation and a subsequent bending operation to provide the configuration illustrated in the drawings.

Figure 6:
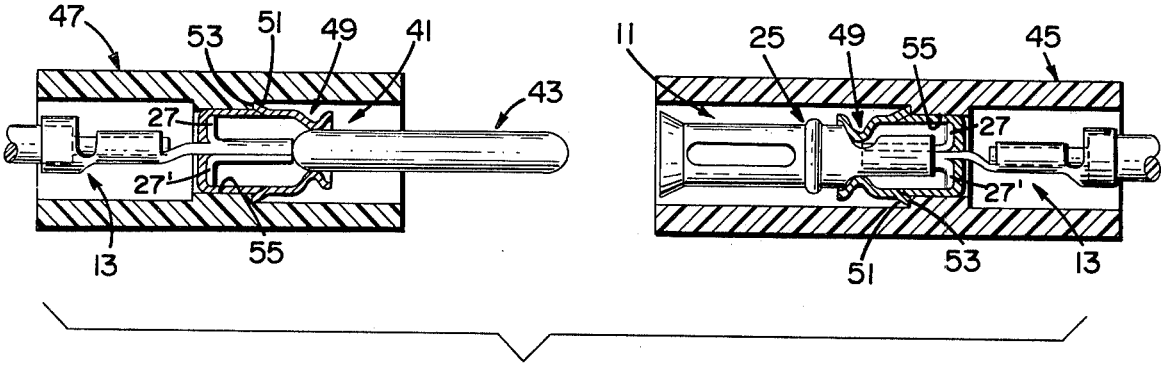
FIG. 6 is a side elevational view of the assembled electrical contacts of FIGS. 2 and 4 positioned within insulative housings.

In FIG. 6 there is shown the previously described contacts 25 and 41 positioned within a pair of respective insulative housings 45 and 47. To facilitate positioning of each of these members within the respective housings, a retention clip member 49 is utilized. As shown in FIG. 6, clip 49 substantially encompasses the upstanding tabs 27 and 27' and is further adapted for engaging a predetermined area on the member (either female contact 11 or male pin 43) which is joined to deformable member 13. Retention clip 49 is further provided with at least one upstanding protrusion portion 51 which in turn is adapted for engaging a recessed inner wall 53 of the housing. Additionally, the clip is adapted for being frictionally inserted within the housing by engagement between an upstanding section 55 of each of said housings.

As clearly shown in FIG. 6, the housings 45 and 47 are of substantially simple configuration and only require therein the described upstanding sections 55 to assure proper positioning and alignment of the respective contact therein. It is to be further understood that with minor modifications that the housings could be identical depending on the amount of penetration of male pin 43 within female receptive member 11.

Figure 7:
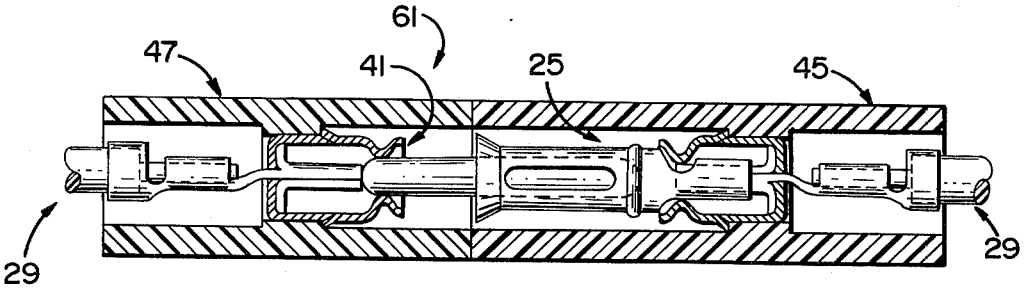
FIG. 7 represents one example of an assembled connector assembly utilizing the separate contact-housing embodiments of FIG. 6.

FIG. 7 represents the assembled connector assembly 61 formed as a result of joining housing 45 and contact 25 with housing 47 and contact 41. As shown, the completed assembly is of substantially simple configuration and provides a positive means for electrically interconnecting a pair of opposingly positioned electrical wires 29. It is understood in the broad concept of the invention that each of the housings illustrated could include therein a plurality of the respectively described contact members to in turn provide a means whereby a plurality of opposingly positioned wires are electrically joined thus completing a series of electrical circuits.

The preferred materials for the components described and illustrated in FIGS. 1–4 may be any metallic materials possessing sound electrically conductive properties. A preferred material for members 11, 13, 43, and 49 is phosphor bronze. A preferred material for the housings 45 and 47 is plastic or any similar electrically insulative material.

Thus, there has been shown and described methods of making two-piece electrical contacts wherein the end products are adaptable to housings of simple configuration and also provide the highly desired feature of interchangeability of parts.

While there have been shown and described what are at present considered the preferred embodiments of this invention it is obvious to those skilled in the art that various changes and modifications may be made therein without departing from the scope of the invention as defined by the following claims.

I claim:

1. A method for making a two-piece electrical contact adapted for electrically interconnecting a male pin and an electrical wire having an electrically conductive lead portion and at least one layer of an electrically insulative material formed substantially about said lead portion, said method comprising:

forming one of said two pieces from a metallic material of substantially uniform thickness to provide a female receptive member including an elongated reception portion for receiving and electrically engaging said male pin and a wrappable end portion, said elongated reception portion being substantially round in configuration and having an open end through which said male pin may enter said reception portion;

forming a second of said two pieces from a metallic material of substantially uniform thickness to provide a deformable member for positively retaining said electrical wire, said deformable member including a first end portion for positively retaining said insulative coating, an intermediate portion for electrically engaging said electrically conductive lead portion, and a multi-layered second end portion opposing said first end portion; and joining said wrappable end portion of said female receptive member to said multi-layered second end portion of said deformable member to provide said two-piece electrical contact, said joining including the steps of wrapping said wrappable end portion substantially about said multi-layered second end portion, followed by welding said multi-layered second end portion to said wrappable end portion after said wrappable end portion has been substantially wrapped about said multi-layered second end portion.

2. The method according to claim 1 wherein said forming of said female receptive member includes a stamping operation.

3. The method according to claim 2 wherein said forming of said female receptive member further includes a bending operation.

4. The method according to claim 1 wherein said forming of said deformable member includes a stamping operation.

5. The method according to claim 4 wherein said forming of said deformable member further includes a bending operation.

* * * * *

UNITED STATES PATENT AND TRADEMARK OFFICE

CERTIFICATE OF CORRECTION

PATENT NO. : 4,031,614

DATED : June 28, 1977

INVENTOR(S) : Richard Earl Gipe

It is certified that error appears in the above-identified patent and that said Letters Patent are hereby corrected as shown below:

Col. 1, line 64 - After "of", please insert -- the prior art --

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*